US005496255A

United States Patent [19]

Chang

[11] Patent Number: 5,496,255

[45] Date of Patent: Mar. 5, 1996

[54] SWINGING BUCKET CENTRIFUGATION ROTOR WITH CONFORMING BUCKET SEAT

[75] Inventor: Kuo-Yen Chang, Santa Clara, Calif.

[73] Assignee: Beckman Instruments, Inc., Fullerton, Calif.

[21] Appl. No.: 353,133

[22] Filed: Dec. 9, 1994

[51] Int. Cl.[6] ..... B04B 5/02

[52] U.S. Cl. ..... 494/20

[58] Field of Search ..... 494/12, 16, 20, 494/33, 43, 85

[56] References Cited

U.S. PATENT DOCUMENTS

| | | | |
|---|---|---|---|
| 3,687,359 | 8/1972 | Scanlon | 494/20 |
| 3,752,390 | 8/1973 | Chulay | 494/20 |
| 3,935,995 | 2/1976 | Williams et al. | 494/20 |
| 3,997,105 | 12/1976 | Hayden et al. | 494/20 |
| 4,190,195 | 2/1980 | Chulay . | |
| 4,400,166 | 8/1983 | Chulay et al. | 494/20 |
| 4,548,596 | 10/1985 | Sutton, III et al. | 494/20 |

FOREIGN PATENT DOCUMENTS

| | | | |
|---|---|---|---|
| 2326492 | 12/1974 | Germany | 494/20 |

*Primary Examiner*—Charles E. Cooley
*Attorney, Agent, or Firm*—William H. May; P. R. Harder; Schneck & McHugh

[57] ABSTRACT

A swinging bucket centrifuge rotor having a conforming bucket seat which includes a plurality of cavities evenly spaced about its vertical axis. Each has a seat portion that with an inward profile generally following the profile of a swinging bucket, subjected to centrifugal forces. A passageway extends entirely through the rotor head and includes a slot extending radially outward from the passageway, positioned so as to bifurcate the seat portion. Located between the vertical axis and the passageway is an improved hanging mechanism that reduces the likelihood of improperly mounting a swinging bucket onto the rotor. Three embodiments of the hanging mechanism are disclosed, each of which is integrally formed with the inner wall of each cavity. The hanging mechanism is positioned so that during centrifugation, the seat portion of the rotor will bear the full centrifugal force of the bucket.

21 Claims, 6 Drawing Sheets

SWINGING BUCKET CENTRIFUGATION ROTOR WITH CONFORMING BUCKET SEAT

TECHNICAL FIELD

The present invention relates to the field of high speed centrifuges. Specifically, the present invention relates to a swinging bucket rotor used at high rotational speeds.

BACKGROUND ART

Swinging bucket centrifuge rotors typically include a rotor head and a plurality of buckets. The buckets contain a sample to be centrifuged and are suspended from the rotor head. The buckets are supported by hangers which enable them to pivot about the mounting axes. When the rotor stops, the buckets hang vertically downward under the influence of gravity. When the rotor is spinning, the buckets swing outward in response to a centrifugal force. In a number of prior designs, an apparatus is incorporated into the rotor to limit the radial movement of the bucket, during centrifugation. Usually the radial movement is restrained by resting the bucket against a shoulder of the rotor head.

Swinging bucket rotors generally come in two designs: top-loaders and bottom-loaders. U.S. Pat. No. 4,190,195 to Chulay discloses a bottom-loading centrifuge rotor. The rotor has a plurality of evenly spaced cavities. The rotor is considered a bottom-loader because each cavity is not accessible from the top of the rotor head. A hanger member, which is spring biased in the radial direction toward the axis of rotation, is included in each cavity. Each hanger member is supported by a guide sleeve with the fastening means extending through it to prevent rotation of a bucket and hanger member. The bucket includes a flange portion proximate to the hanger member. The bucket is mounted so that the flange rests against the shoulder of the rotor, during centrifugation.

U.S. Pat. No. 4,400,166 to Chulay et al. discloses a top-loading centrifuge rotor. The rotor includes a rotor head and a plurality of evenly spaced cavities. Each cavity is cylindrical and extends through the rotor head, parallel to the spin axis, and includes two opposed grooves. The grooves extend from the top of the cavity and terminate proximate to the bottom of the cavity, forming a pocket to receive a hanger rod of a bucket. Each bucket is placed into the cavity from the top of the rotor, so that during centrifugation, a shoulder of the rotor head supports the flange portion of the bucket.

Each of the aforementioned designs has innate disadvantages. For example, the bottom loaders have the disadvantage that the operator cannot easily mount the buckets and may occasionally mount them incorrectly. As a result, during centrifugation the bucket may not pivot as intended and may become detached causing substantial damage to the sample, bucket and/or centrifuge. The top loading centrifuge requires the presence of large apertures bored through the rotor head. This results in a reduction in the number of buckets that may be suspended from the rotor head. In addition, neither of the aforementioned designs has a shoulder that is able to provide uniform support to the flange of a bucket. This substantially reduces the speeds at which a rotor may operate, as well as substantially reduce the rotor's operational life.

It is an object, therefore, of the present invention to provide an improved centrifuge rotor that is capable of operating at substantially higher speeds while maintaining a longer operational life than those disclosed in the prior art.

It is a further object of the present invention to provide a centrifuge rotor with an improved system by which to suspend the buckets that substantially reduces the likelihood of improperly mounting them onto the rotor.

DISCLOSURE OF THE INVENTION

These objectives have been achieved by providing a centrifuge rotor head adapted to rotate about its vertical axis, with a plurality of swinging buckets suspended from it. The rotor head has a plurality of cavities evenly spaced about its vertical axis. Each cavity is constructed to receive and support a bucket on a hanger rod for pivotal movement of the bucket between a vertical position, when the rotor head is stationary, and a horizontal position, when a centrifugal force developed through rotation of the rotor head overcomes the influence of gravity on the bucket. Each cavity includes an inner wall located proximate to the vertical axis of the rotor head, and an upper wall extending radially outward away from the vertical axis. The upper wall has two opposing side portions that extend downwardly with the upper wall and two side portions defining a chamber and a seat portion. The chamber has an aperture positioned at the peripheral surface of the rotor head. The seat portion includes a shoulder that has an inward profile generally following the profile of the bucket, extending horizontally during centrifugation. A passageway extends entirely through the rotor head. A slot extends radially outward from the passageway and is positioned so as to bifurcate the seat portion.

Located between the vertical axis and the passageway is a hanging mechanism. The hanging mechanism is integrally formed with the inner wall, and may include an angled channel having a bore positioned proximate to the upper wall that extends inwardly toward the vertical axis away from the chamber, connecting to a vertical channel. The vertical channel extends downwardly parallel with the vertical axis and terminates in a pocket. The pocket is designed to receive a hanger rod of a centrifuge bucket. The vertical channel may have a front surface, facing the vertical axis, and a rear surface facing the chamber. The rear surface may be isotropic in that it is relatively smooth. The forward surface may, however, not be smooth. Rather, the forward surface may be anisotropic in that it has an inclined portion positioned proximate to the pocket that extends downwardly and outwardly toward the chamber, thereby providing the pocket with a width greater than the width of the vertical channel.

Another hanging mechanism may include a pair of opposed grooves, each including a vertical channel with a bore positioned proximate to the opening of the chamber. The vertical channel may extend upwardly away from the bore toward the upper surface of the rotor, parallel to the vertical axis and terminates in a hook portion. The hook portion may follow the vertical channel and curve towards the vertical axis away from the chamber and include an inclined groove extending downwardly therefrom, forming a socket.

Each of these hanging mechanisms is positioned in the inner wall so that during centrifugation, the seat portion of the rotor will bear the full centrifugal force of the bucket. The hanger is used only as a pivot point.

BEST MODE FOR CARRYING OUT THE INVENTION

Figure 1:
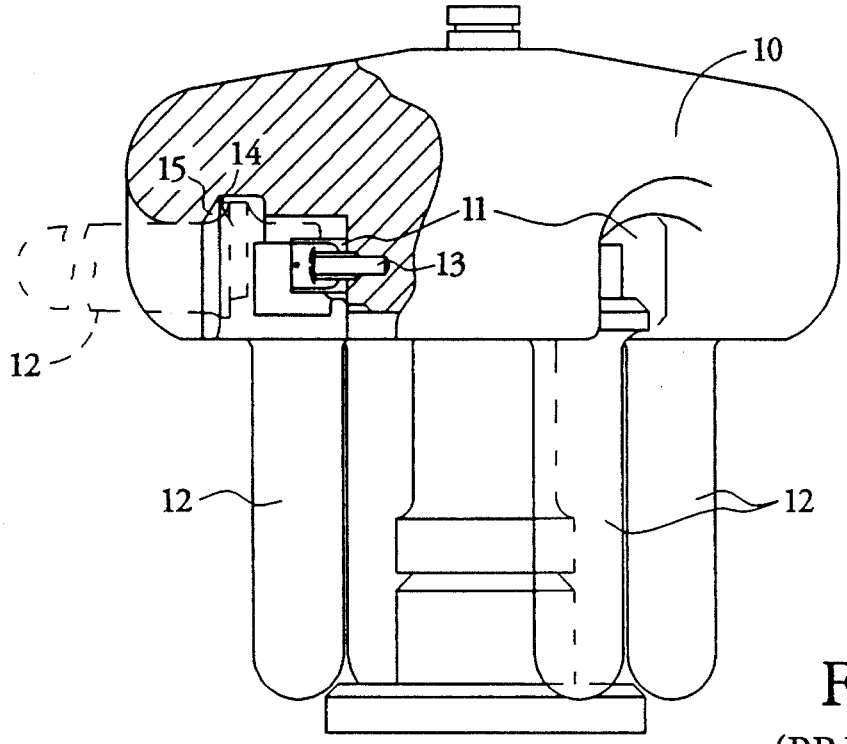
FIG. 1 (PRIOR ART)
FIG. 1 is a plan view, in partial cross section, showing the rotor head of the prior art.

FIG. 1 shows a prior art centrifuge rotor head 10 that includes a plurality of evenly spaced cavities 11 with a swinging bucket 12 disposed in them, which contains a sample to be centrifuged. A mechanical pivot 13 is provided within each cavity 11 which allows the bucket 12 to pivot from a vertical position to a horizontal position, as shown by the dashed line, during centrifugation. When in the horizontal position, the flange 14 of each bucket 12 rests against a shoulder 15 of the rotor head 10. In this configuration, the shoulder 15, bears the full centrifugal force of the bucket 12, without subjecting the mechanical pivot 13 to undue stress during centrifugation. To improve the strength of the rotor head 11, it is desirable to provide the maximum area against which the flange 14 may rest. This reduces the stress per unit area on the rotor head 10. To that end, rotor head 11 does not have any apertures or openings in the shoulder 15.

Figure 2:
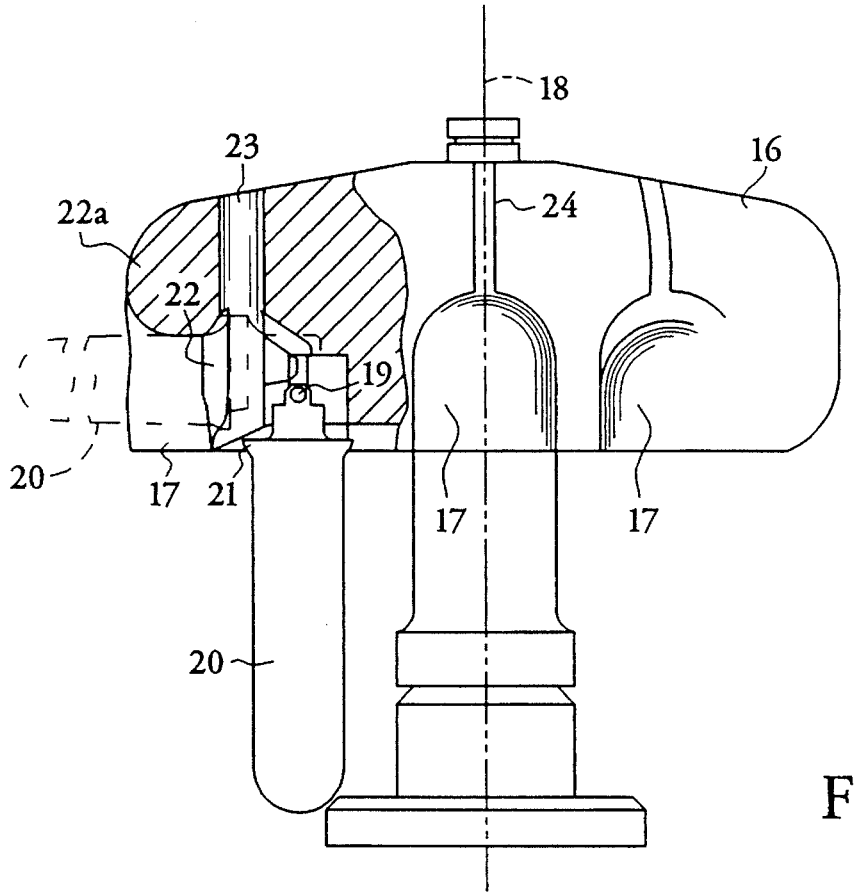
FIG. 2 is a plan view, in partial cross section, showing the rotor head of the present invention.

The present invention, as shown in FIG. 2, is based, in part, on the discovery that the force on the bucket is not uniformly applied to the seat. Rather, there are substantial portions of the seat which do not experience a substantial amount of the forces of the bucket. This results in an increase in the force per unit area against the rotor head, which substantially reduces its operational life, and at times, causes rotor failure. The present invention is similar to the prior art in that rotor head 16 includes a plurality cavities 17, evenly spaced about the vertical axis 18 of the rotor, each of which includes a pivot mechanism 19 that permits a swinging bucket 20 to pivot from a vertical position to a horizontal position, as shown by the dashed line, when the bucket 20 is subjected to a centrifugal force. When in the horizontal position, the bucket flange 21 rests against the shoulder 22 of the seat portion 22*a*, which is typically integrally formed into the body of the rotor head 16.

Figure 3:
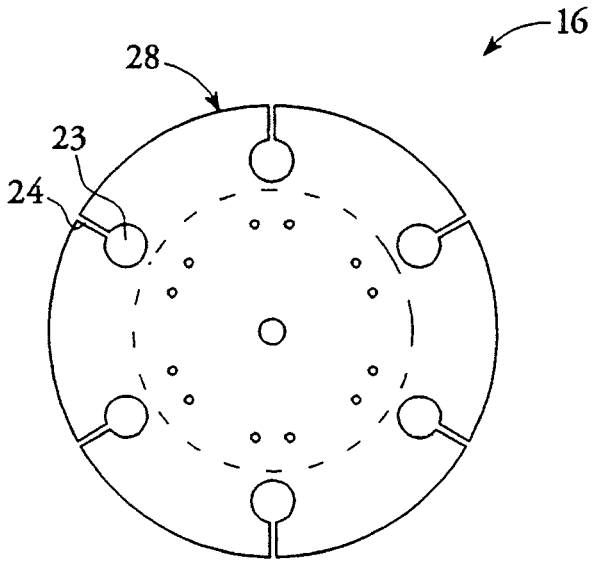
FIG. 3 is a top view of the rotor head of the present invention.

To overcome the defects in the prior art, however, each cavity 17 has a cylindrical passageway 23, also shown in FIG. 3, extending through the rotor head 16. Although the orientation of the passageway 23 with respect to the vertical axis 18 is not critical, the preferred embodiment orientates the longitudinal axis of the passageway 23 parallel to the vertical axis 18 of the rotor head 16. A slot 24 extends radially from the passageway 23 to the peripheral surface 28 of the rotor head 16 so as to bifurcate the seat portion 22*a* and the shoulder 22 into two spaced-apart portions in opposing relation to one another. Although not necessary to practice the invention, the preferred embodiment positions the slot 24 so that it bifurcates the seat portion into two spaced-apart symmetrical portions. The slot 24 and passageway 23 configuration was prompted by the discovery that the problems with the prior art were caused by deformation of the seat portion 22*a* during centrifugation. With this structure, the rotor head 16 was weakened, in the proper area, and to the extent necessary, to obtain uniform deformation along the entire seat portion 22*a*, thereby maintaining maximum contact of the shoulder 22 with the flange 21.

Figure 4B:
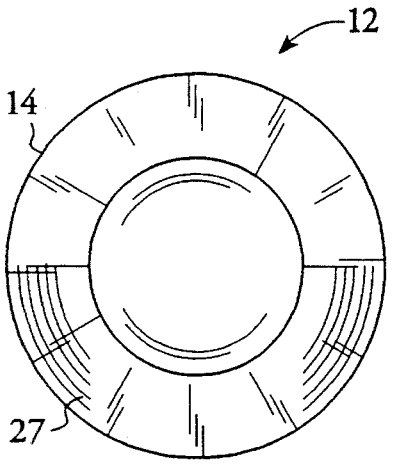
FIG. 4B (PRIOR ART)
FIG. 4B illustrates the surface contact between a centrifuge bucket and the rotor head shown in FIG. 1, during centrifugation.
Figure 4D:
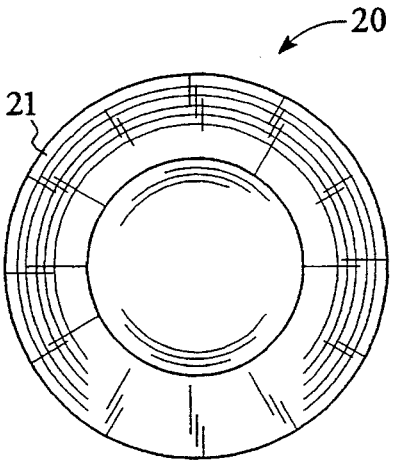
FIG. 4D illustrates the surface contact between a centrifuge bucket and the rotor head of the present invention.
Figure 4A:
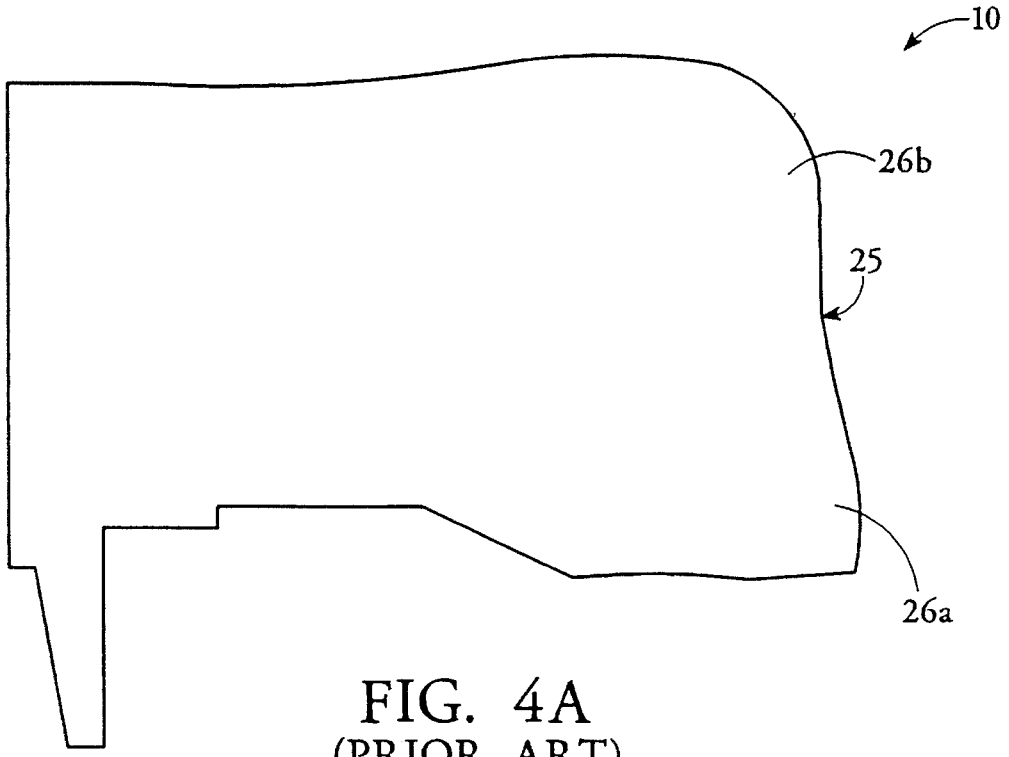
FIG. 4A (PRIOR ART)
FIG. 4A illustrates the peripheral deformation of the rotor head shown in FIG. 1 during centrifugation.
Figure 4C:
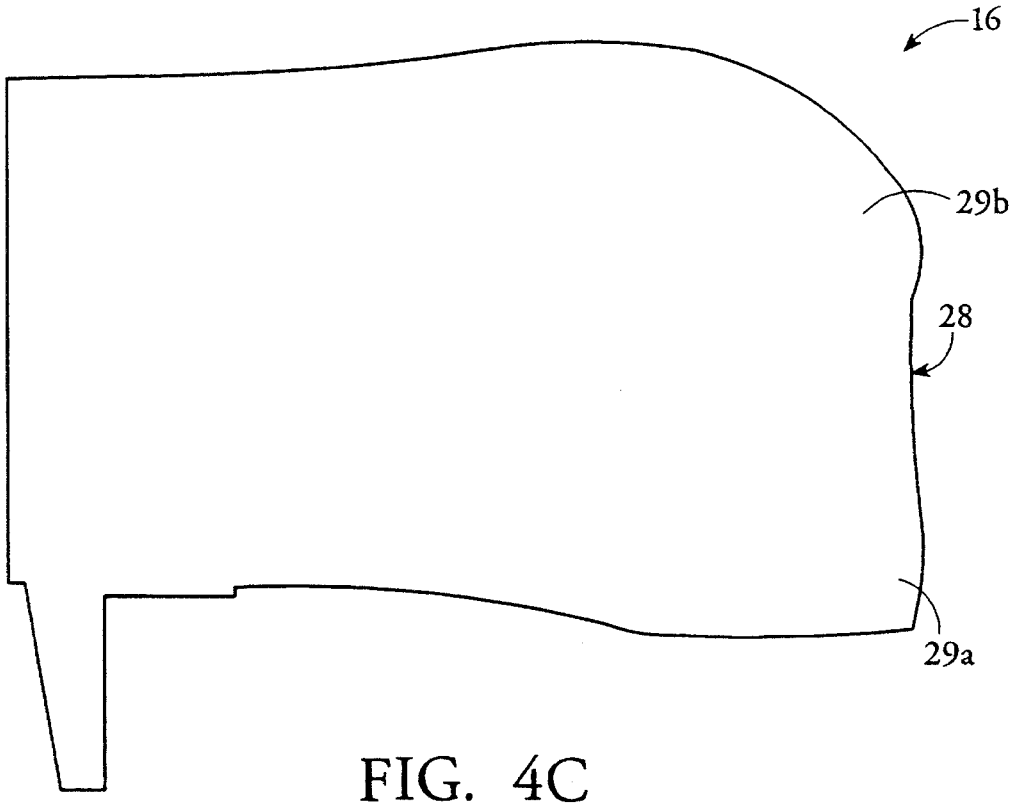
FIG. 4C illustrates the peripheral deformation of the rotor head of the present invention.

FIGS. 4A, 4B, 4C and 4D demonstrate the discovery made by Applicant. The peripheral surface 25 of the prior art rotor 10 deforms during centrifugation. As a result of the centrifugal forces exerted on it, the lower portion 26*a* extends further radially outward, away from the vertical axis (not shown), than the upper portion 26*b*. This causes the seat portion to deform, allowing a bucket 12 to pivot so that the upper portion 27 of the flange 14 is spaced apart from the shoulder of the rotor. The area of the flange left resting against the shoulder is shown in FIG. 4B, as shaded. The hole and slot of the present invention increase the amount of peripheral deformation of rotor head 16, thereby decreasing the relative deformation between the upper 29*b* and lower 29*a* portions. In the present invention, the peripheral surface 28 maintains a substantially planar structure so that the lower portion 29*a* of rotor head 16 does not cause the shoulder to deform. This prevents the bucket 20 from pivoting, thereby allowing a substantial portion of the upper surface 21 of the flange to rest against the shoulder of the seat portion, as shown by the shaded portion of FIG. 4D. Therefore, the force per unit area on the rotor head 16 is decreased on the rotor head 16.

Figure 5:
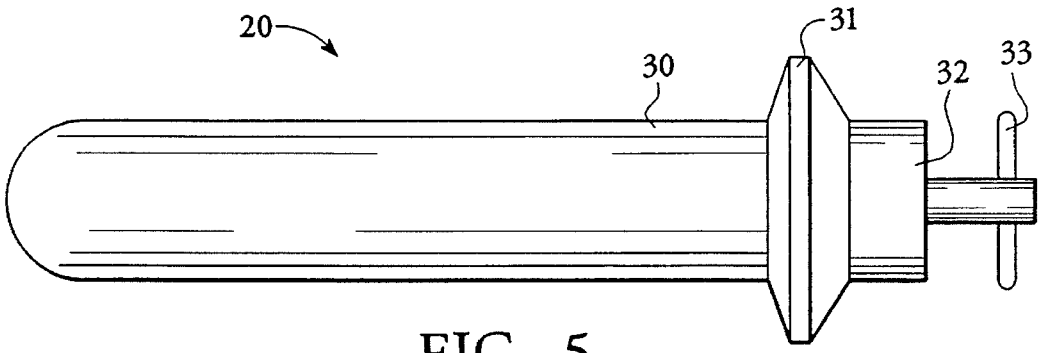
FIG. 5 is a perspective view of a centrifuge swinging bucket used in the present invention.

FIG. 5 shows the bucket employed in the present invention as including a tubular portion 30 which is closed at one end. A flange structure 31 is located opposite the closed end and positioned to fit the seat portion of the rotor head. A cap 32, typically threaded onto the tubular portion 30, includes a hanger rod 33, disposed transversely of the tubular portion 30.

Figure 7:
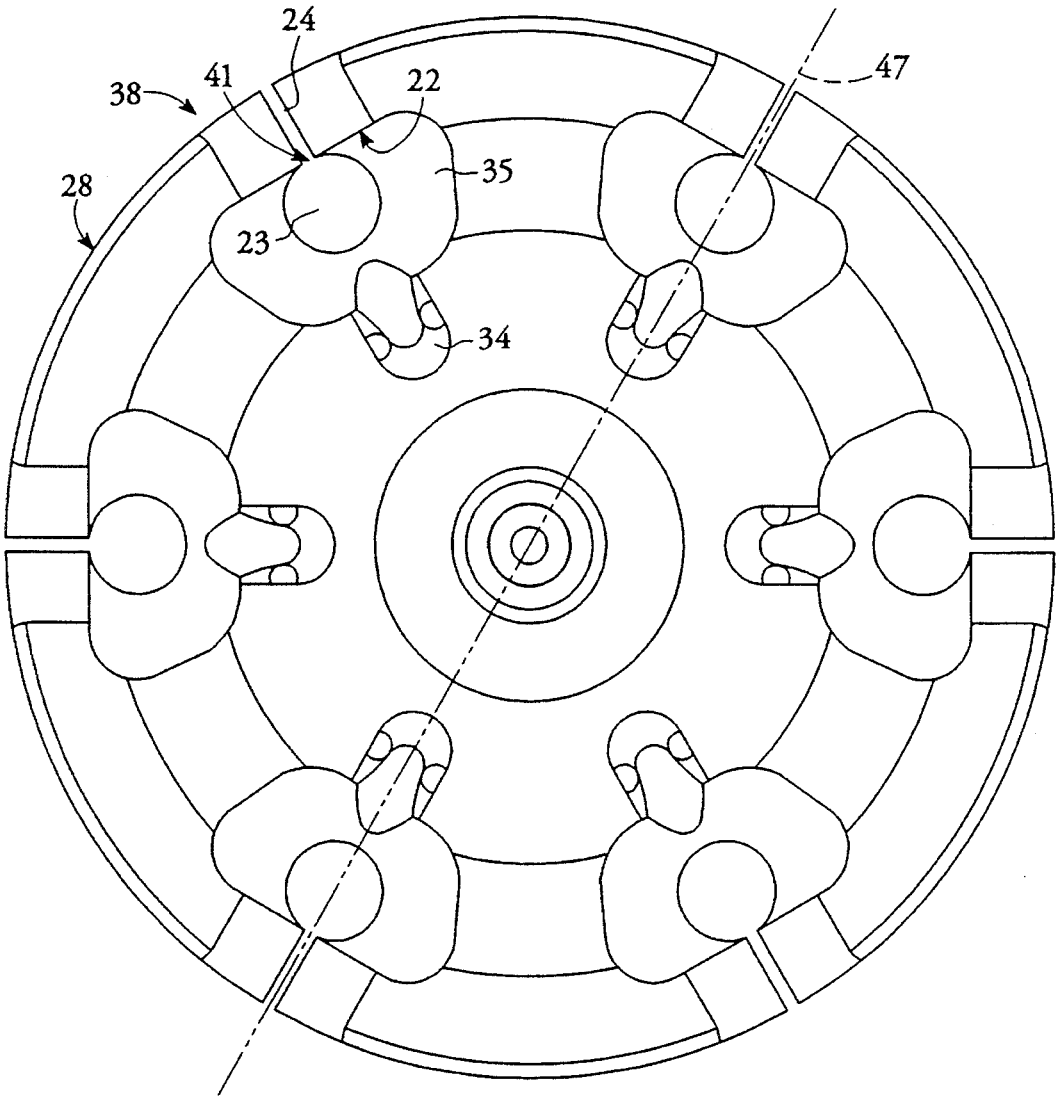
FIG. 7 is a bottom view of the rotor head of the present invention.
Figure 6:
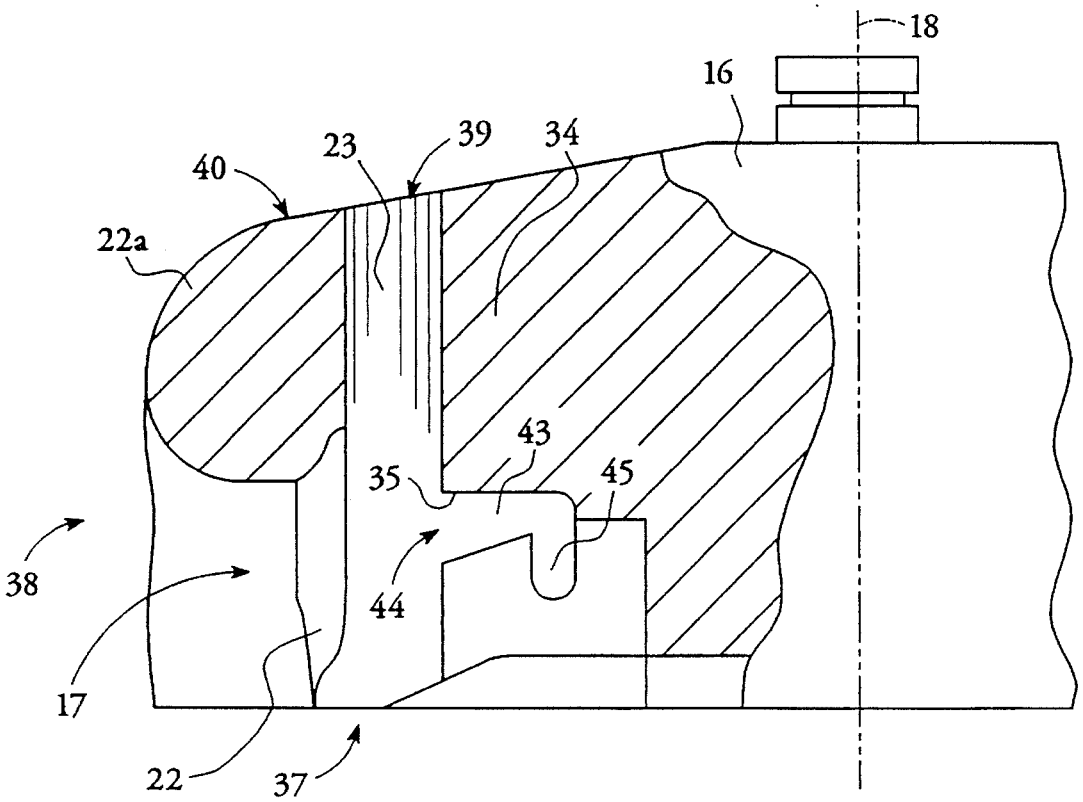
FIG. 6 is a plan view of a first embodiment of the hanging mechanism for a swinging bucket.

FIGS. 6 and 7 each shows a cavity 17 as including an inner wall 34 formed as a recess into the rotor head 16 and disposed proximate to the vertical axis 18. An upper wall 35 is also formed into the rotor body so that it extends radially outward away from the inner wall 34 and has two opposing side portions that extend downwardly therefrom which terminate in an opening 37, defining a chamber to receive a swinging bucket. The chamber includes an aperture 38 located at the peripheral surface 28 of the rotor head 16. Also included in the chamber is a shoulder 22, positioned so as to bear the full centrifugal force of the bucket, during centrifugation. The shoulder 22 transmits this force to the seat portion 22*a*, which substantially reduces the force per unit area experienced by the rotor head 16. The opening 37 and the aperture 38 are of sufficient size so as to allow a swinging bucket to pass therethrough and rest upon the shoulder 22.

Each chamber includes a cylindrical passageway 23 extending from the chamber. As mentioned before, the orientation of the longitudinal axis of the passageway 23 with respect to the vertical axis 18 is not critical. Nonetheless, the preferred embodiment orientates the longitudinal axis of the passageway 23 parallel to the vertical axis 18.

The passageway 23 typically has a diameter substantially smaller than the bucket. This necessitates mounting the buckets from underneath the upper surface 40, but allows more buckets to be suspended from it, than a top-loading rotor head. The passageway 23 terminates in a hole 39 located at the upper surface 40 of the rotor head 16 and is positioned within the chamber so that the shoulder 22 connects to it, at region 41. At region 41, and extending radially outward, a portion of the rotor head 16 is removed, defining a slot 24. The width of the slot 24 is substantially narrower than the diameter of the passageway 23, thereby preventing structural degradation of the rotor head during high speed centrifugation. The slot, chamber, passageway and inner wall are positioned so that each is symmetrical about an axis 47 that lies along a common plane, which is orthogonal to the vertical axis 18. Integrally formed with the inner wall 34 is the hanging support mechanism.

Referring again to FIGS. 6 and 7, the first preferred embodiment of the hanging support mechanism is shown as including a pair of opposed grooves, each positioned on opposite sides on the axis 47. Each groove includes an angled channel 43 having an aperture 44 positioned adjacent to the upper wall 35. The angled channel 43 extends inwardly and upwardly away from the chamber toward the vertical axis 18, connecting to a vertical channel 45. The angled channel 43, however, may extend inwardly and upwardly toward the vertical axis 18 or inwardly, perpendicular to the axis 18. The vertical channel 45 extends downwardly, parallel to the vertical axis 18, away from the angled channel 43, terminating in a pocket. The angled channel is structured so that the mounting of the bucket is a binary operation. If the bucket is properly mounted, it will traverse angled channel 43 and come into contact with vertical channel 45, at which point it will slide down the vertical channel 45 into the pocket. If the bucket is improperly mounted, it will not slide down the vertical channel; rather, it will slide down angled channel 43, falling out of the rotor head 16, thereby immediately alerting the operator of the mounting problem.

Figure 8:
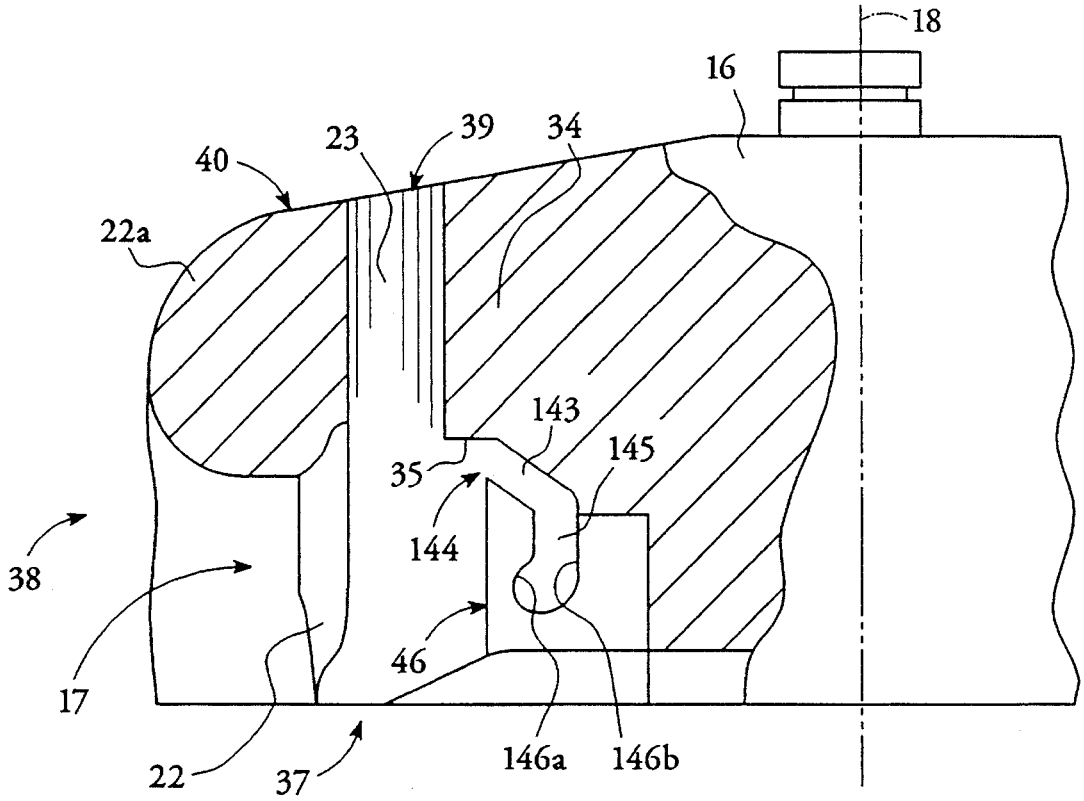
FIG. 8 is a plan view of a second embodiment of the hanging mechanism for a swinging bucket.

FIG. 8 shows a second embodiment of the hanging support mechanism, shown as including a pair of opposed grooves, each positioned on opposite sides on the axis 47. Each groove includes an angled channel 143 having a bore 144 positioned adjacent to the upper wall 35. The angled channel 143 may be angled in the same manner as angled channel 43 described with respect to FIG. 6. In this example, however, angled channel 143 extends inwardly away from the chamber and downwardly toward the vertical axis 18, connecting to a vertical channel 145. The vertical channel 145 extends downwardly, parallel to the vertical axis 18, away from the angled channel 143, terminating in a pocket. Unlike the preferred embodiment, the vertical channel may include a detent. The vertical channel 145 has a forward surface **146*a* facing the vertical axis 18, and a rear surface 146*b*, facing the chamber. The rear surface 146*b* is isotropic in that it is relatively smooth. The forward surface is anisotropic. At the end, opposite of the angled channel 143, the forward surface 146*a* angles towards the chamber, defining a detent. The detent provides the pocket with a width greater than the width of the vertical channel 145, which prevents egress of the bucket from the channels. It is important to note that the inner wall 34 surface surrounding the bore 144 is smooth. As before, the mounting of a bucket becomes a binary operation. If the bucket is properly mounted, it will slide down the angled channel 143 into the pocket. If the bucket is improperly mounted, the planar sides of the inner wall will result in the bucket falling out of the rotor head 16**, thereby immediately alerting the operator of the mounting problem.

Figure 9:
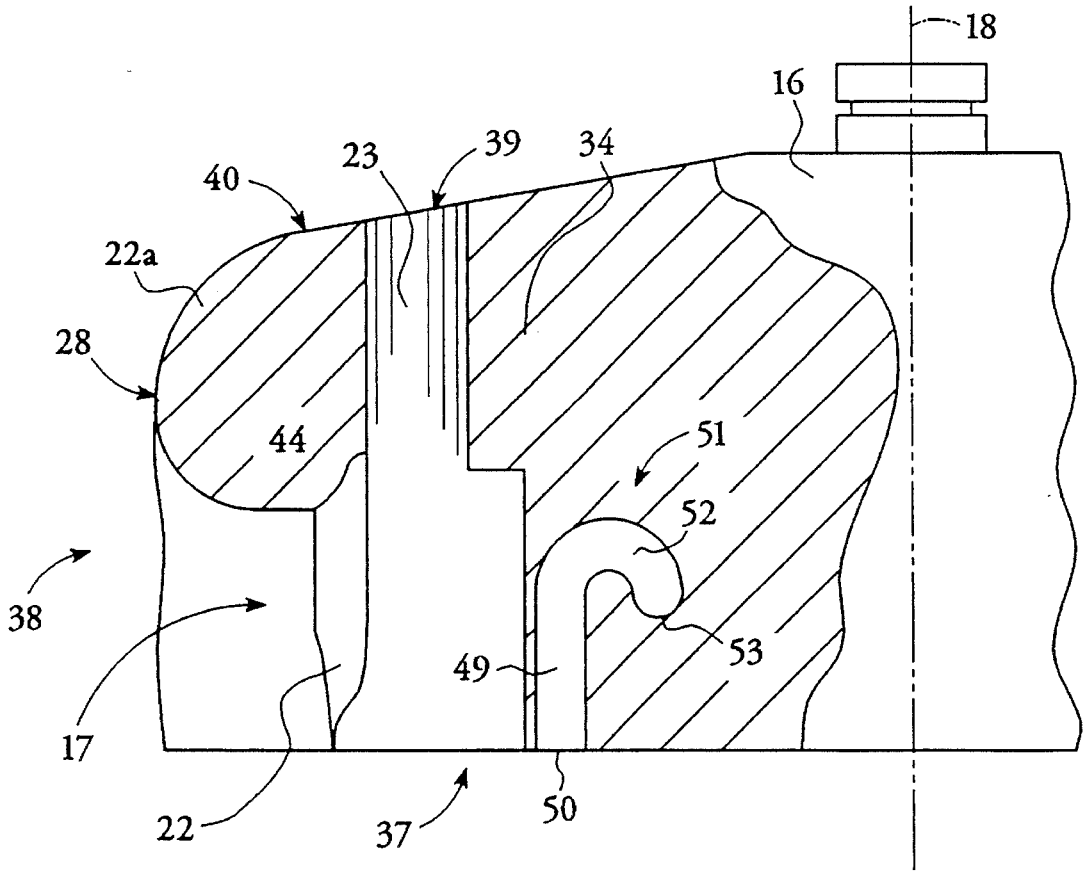
FIG. 9 is a plan view of a third embodiment of the hanging mechanism for a swinging bucket.

FIG. 9 shows a third embodiment of the hanging mechanism with each groove including a vertical channel 49 having a bore 50 positioned proximate to the opening 37 of the chamber. The vertical channel 49 extends upwardly away from the aperture 50 toward the upper surface 40 of the rotor head 16, parallel to the vertical axis and terminates in a hook portion 51. The hook portion follows the vertical channel and curves towards the vertical axis away from the chamber and includes an inclined groove 52 extending downwardly therefrom and forming a socket 53. This design provides the binary mounting operation discussed above. The vertical channel 49 is smooth. If the bucket is properly mounted, it will slide down the inclined groove 52 into the socket. If the bucket is improperly mounted, it will slide down the vertical channel 49 and out of the rotor head 16. This will immediately notify an operator of an improper mount. Each of the aforementioned hanging mechanisms is positioned in the inner wall 34 so that during centrifugation, the flange of the bucket rests against the shoulder, resulting in the seat portion of the rotor bearing the full centrifugal force of the bucket. The socket of each of the hanging mechanisms supports a hanger rod of the bucket, the socket is used only as a pivot point.

The invention claimed is:

1. A centrifuge rotor comprising:

a rotor head with a plurality of spaced apart cavities, each of the plurality of spaced cavities defined by an inner wall of the rotor head, disposed proximate to a vertical axis of the rotor, and an upper wall of the rotor head, extending radially outward away from the vertical axis and including two opposing side portions extending downwardly from the upper wall and terminating in an opening, with the upper wall, the inner wall and the two opposing side portions defining a chamber and a seat portion, the chamber having an aperture positioned at a peripheral surface of the rotor head, the upper wall including a passageway extending from the opening and terminating in a hole proximate to an upper surface of the rotor head, the upper wall including a slot extending radially outward from the passageway and positioned so as to bifurcate the seat portion.

2. The centrifuge rotor as recited in claim 1 wherein the passageway is cylindrical in shape and has a diameter that is greater than the width of the slot.

3. The centrifuge rotor as recited in claim 1 wherein the slot bifurcates the seat portion into two spaced apart symmetrical portions in opposing relation to one another.

4. The centrifuge rotor as recited in claim 1 further including a bucket and means for supporting the bucket within the chamber.

5. The centrifuge rotor as recited in claim 4 wherein the supporting means is positioned between the vertical axis and the passageway.

6. The centrifuge rotor as recited in claim 4 wherein the supporting means is a pair of opposed grooves integrally formed with the inner wall.

7. The centrifuge rotor as recited in claim 4 wherein the passageway is cylindrical and has a diameter substantially less than a diameter of the bucket.

8. The centrifuge rotor as recited in claim 4 wherein the supporting means is a pair of opposed grooves defined by the inner wall with each groove shaped as an angled channel having a bore, with the bore formed into the inner wall and positioned proximate to the upper wall, the angled channel extending inwardly and upwardly toward the vertical axis, with a vertical channel following the angled channel that extends downwardly away from the angled channel, terminating in a socket, whereby a proper mounting of a hanger rod of the bucket results in the rod sliding through both channels and resting in the sockets so that the seat portion supports the bucket during centrifugation, and an improper mounting of the hanger rod of the bucket results in the bucket sliding down along the inner wall.

9. The centrifuge rotor as recited in claim 4 wherein the supporting means is a pair of opposed grooves defined by the inner wall with each groove shaped as an angled channel having a bore, with the bore formed into the inner wall and positioned proximate to the upper wall, the angled channel extending inwardly and downwardly toward the vertical axis, terminating in a socket, whereby a proper mounting of a hanger rod of the bucket results in the rod sliding down both channels and resting in the sockets so that the seat portion supports the bucket during centrifugation, and an improper mounting of the hanger rod of the bucket results in the bucket sliding down along the inner wall.

10. The centrifuge rotor as recited in claim 4 wherein the supporting means is a pair of opposed grooves defined by the inner wall with each groove shaped as a vertical channel having a bore positioned proximate to the opening and extending upwardly, parallel to the vertical axis, toward the upper surface and terminating in an angled ramp, the ramp extending inwardly and downwardly toward the vertical axis and terminating in a socket, whereby a proper mounting of a hanger rod of the bucket results in the rod sliding into the sockets to support the hanger rod of the bucket, thereby enabling the bucket to pivot under a centrifugal force upwardly into the chamber so that the seat portion supports the bucket during centrifugation, and an improper mounting of the hanger rod of the bucket results in the bucket sliding down along the vertical channel.

11. A centrifuge rotor comprising:

a rotor head with a plurality of cavities spaced about a circumference of the rotor head with each cavity defined by an inner wall of the rotor head, disposed proximate to a vertical axis of the rotor, an upper wall of the rotor head, extending radially outward away from the vertical axis, and two opposing side portions extending downwardly from the upper wall, with the inner wall, upper wall and the two opposing side portions defining a chamber with an aperture positioned at a peripheral surface of the rotor head and a seat portion, the upper wall including a passageway having a longitudinal axis parallel to the vertical axis and extending from the aperture and terminating in a hole proximate to an upper surface of the rotor head, the upper wall including a slot extending radially outward from the passageway and positioned so as to bifurcate the seat portion; and a pivotal support positioned between the vertical axis and the passageway.

12. The centrifuge rotor as recited in claim 11 wherein the pivotal support is a pair of opposed slots integrally formed with the inner wall.

13. The centrifuge rotor as recited in claim 11 further including a bucket having a hanger rod, wherein the pivotal support is a pair of opposed grooves defined by the inner wall with each groove shaped as an angled channel having a bore, with the bore formed into the inner wall and positioned proximate to the upper wall, the angled channel extending inwardly and upwardly toward the vertical axis, with a vertical channel following the angled channel that extends downwardly away from the angled channel, terminating in a socket, whereby a proper mounting of the bucket results in the hanger rod sliding through both channels and resting in the sockets so that the seat portion supports the bucket during centrifugation, and an improper mounting of the bucket results in the bucket sliding down along the inner wall.

14. The centrifuge rotor as recited in claim 11 further including a bucket having a hanger rod, wherein the seat portion has a profile conforming to a profile of the bucket, and wherein the pivotal support is a pair of opposed grooves defined by the inner wall with each groove shaped as an angled channel having a bore positioned proximate to the upper wall and extending inwardly toward the vertical axis, terminating in a vertical channel, the vertical channel extending downwardly away from the angled channel into a terminus, with the vertical channel having a forward surface which includes a detent, facing the vertical axis, and a smooth rear surface, opposing the forward surface and facing the chamber, so that the terminus of the vertical channel defines a pocket having a width greater than a width of the vertical channel to support the hanger rod of the bucket, thereby enabling the bucket to pivot under a centrifugal force upwardly into the chamber so that the seat portion supports the bucket during centrifugation.

15. The centrifuge rotor as recited in claim 11 further including a bucket having a hanger rod wherein the pivotal support is a pair of opposed grooves defined by the inner wall with each groove shaped as a vertical channel having a bore positioned proximate to the aperture and extending upwardly, parallel to the vertical axis, toward the upper surface and terminating in an angled ramp, the ramp extending inwardly and downwardly toward the vertical axis and terminating in a socket to support the hanger rod of the bucket, thereby enabling the bucket to pivot under a centrifugal force upwardly into the chamber so that the seat portion supports the bucket during centrifugation.

16. A centrifuge rotor comprising:

a bucket having a hanger rod;

a rotor head with a plurality of cavities, evenly spaced about a circumference of the rotor head with each cavity defined by an inner wall of the rotor head, disposed proximate to a vertical axis of the rotor, an upper wall of the rotor head, extending radially outward away from the vertical axis, and two opposing side portions extending downwardly from the upper wall, with the inner wall, upper wall and the two opposing side portions defining a chamber with an aperture positioned at a peripheral surface of the rotor head and a seat portion having an inward profile following a profile of the bucket, the upper wall including a passageway having a longitudinal axis parallel to the vertical axis and extending from the aperture and terminating in a hole, proximate to an upper surface of the rotor head, the upper wall including a slot extending radially outward from the passageway and positioned so as to bifurcate the seat portion into two spaced apart symmetrical halves; and means, defined by the inner wall, for pivotally supporting the bucket within the chamber, the supporting means including a pair of opposed grooves with each formed as an angled channel having a bore positioned proximate to the upper wall and extending inwardly and upwardly toward the vertical axis, connecting to a vertical channel, the vertical channel extending downwardly away from the angled channel, parallel to the vertical axis, terminating in a pocket to support the hanger rod of the bucket, thereby enabling the bucket to pivot under a centrifugal force upwardly into the chamber so that the seat portion supports the bucket during centrifugation.

17. The centrifuge rotor as recited in claim 16 wherein the passageway is cylindrical and has a diameter substantially less than a diameter of the bucket.

18. The centrifuge rotor as recited in claim 17 wherein the supporting means is positioned between the vertical axis and the passageway.

19. A centrifuge rotor comprising:

a bucket having a hanger rod; and a rotor head with a plurality of cavities, evenly spaced about a circumference of the rotor head with each cavity defined by an inner wall of the rotor head, disposed proximate to a vertical axis of the rotor, an upper wall of the rotor head, extending radially outward away from the vertical axis, and two opposing side portions extending downwardly from the upper wall with the inner wall, upper wall and two opposing side portions defining a chamber with an aperture positioned at a peripheral surface of the rotor head and a seat portion having an inward profile following a profile of the bucket, the upper wall having a passageway extending from the aperture to an upper surface of the rotor head, the seat portion being bifurcated by a slot extending radially between an outer surface of the rotor head and the passageway, the inner wall defining a pair of opposed grooves, each formed as an angled channel having a bore, with the bore formed into the inner wall and positioned proximate to the upper wall, and the angled channel extending inwardly and upwardly toward the vertical axis, with a vertical channel following the angled channel, the vertical channel extending downwardly away from the angled channel, terminating in a pocket, whereby a proper mounting of the hanger rod of the bucket results in the rod sliding down both channels, resting in the pocket to support the hanger rod of the bucket, to enable the bucket to pivot under a centrifugal force upwardly into the chamber so that the seat portion supports the bucket during centrifugation and an improper mounting of the hanger rod of the bucket results in the bucket sliding down the angled channel.

20. A centrifuge rotor comprising:

a bucket having a hanger rod; and a rotor head with a plurality of cavities, evenly spaced about a circumference of the rotor head with each cavity defined by an inner wall of the rotor head, disposed proximate to a vertical axis of the rotor, an upper wall of the rotor head, extending radially outward away from the vertical axis, and two opposing side portions extending downwardly from the upper wall, with the inner wall, upper wall and two opposing side portions defining a chamber with an aperture positioned at a peripheral surface of the rotor head and a seat portion having an inward profile following a profile of the bucket, the inner wall defining a pair of opposed grooves, each formed as an angled channel having a bore, with the bore formed into the inner wall and positioned proximate to the upper wall, the angled channel extending inwardly and downwardly toward the vertical axis and connecting to a downwardly extending vertical channel which terminates in a pocket, the pocket having a width that is greater than a width of the vertical channel, whereby a proper mounting of the hanger rod of the bucket results in the hanger rod sliding down both channels, resting in the pocket to support the hanger rod of the bucket, to enable the bucket to pivot under a centrifugal force upwardly into the chamber so that the seat portion supports the bucket during centrifugation and an improper mounting of the hanger rod of the bucket results in the bucket sliding down the inner wall.

21. A centrifuge rotor comprising:

a bucket having a hanger rod; and a rotor head with a plurality of cavities, evenly spaced about a circumference of the rotor head, with each cavity defined by an inner wall of the rotor head, disposed proximate to a vertical axis of the rotor, an upper wall of the rotor head, extending radially outward away from the vertical axis, and two opposing side portions extending downwardly from the upper wall, with the inner wall, upper wall and the two opposing side portions defining a chamber with an aperture positioned at a peripheral surface of the rotor head and a seat portion having an inward profile following a profile of the bucket, with the inner wall defining a pair of opposed grooves, each groove being formed as a vertical channel having a bore positioned proximate to the aperture and extending upwardly toward the upper surface and terminating in an angled ramp, with the ramp extending inwardly and downwardly toward the vertical axis, terminating in a socket to support the hanger rod of the bucket, thereby enabling the bucket to pivot under a centrifugal force upwardly into the chamber so that the seat portion supports the bucket during centrifugation.

* * * * *